US010518852B2

(12) United States Patent
Golden

(10) Patent No.: US 10,518,852 B2
(45) Date of Patent: Dec. 31, 2019

(54) WATERCRAFT SUPPORTING BUNK ASSEMBLY

(71) Applicant: William Golden, North Fort Myers, FL (US)

(72) Inventor: William Golden, North Fort Myers, FL (US)

( * ) Notice: Subject to any disclaimer, the term of this patent is extended or adjusted under 35 U.S.C. 154(b) by 0 days.

(21) Appl. No.: 16/194,675

(22) Filed: Nov. 19, 2018

(65) Prior Publication Data

US 2019/0152571 A1 May 23, 2019

Related U.S. Application Data

(60) Provisional application No. 62/587,619, filed on Nov. 17, 2017.

(51) Int. Cl.
*B63C 3/12* (2006.01)
*B63C 3/06* (2006.01)
*B63C 3/02* (2006.01)

(52) U.S. Cl.
CPC ..... *B63C 3/06* (2013.01); *B63C 3/02* (2013.01); *B63C 3/12* (2013.01)

(58) Field of Classification Search
CPC .... B63C 3/06; B63C 3/12; B63C 1/10; B63C 2005/022
USPC ..... 405/3, 7; 280/414.1
See application file for complete search history.

(56) References Cited

U.S. PATENT DOCUMENTS 6,247,719 B1 * 6/2001 Youmans ..... B60P 3/1066 280/414.1
6,830,410 B2 * 12/2004 Davidson ..... B63C 3/06 280/414.1
7,581,745 B2 * 9/2009 Remedios ..... B60P 3/1066 280/414.1
8,388,265 B2 * 3/2013 Basta ..... B63C 3/06 405/3
2013/0004238 A1 * 1/2013 Doig ..... B63C 3/06 405/3
2015/0158566 A1 * 6/2015 Doig ..... B63C 3/06 405/7
2015/0197322 A1 * 7/2015 Doig ..... B63C 3/12 405/2
2019/0071157 A1 * 3/2019 Hewitt ..... B63C 3/06

* cited by examiner

*Primary Examiner* — Frederick L Lagman
(74) *Attorney, Agent, or Firm* — William E. Noonan

(57) ABSTRACT

A watercraft bunk assembly includes a lower base that is secured to a support post of a boat lift or other boat supporting structure. A separate upper base is slidably interengaged with the lower base. The upper base is configured to carry a cushion component at an angular inclination for engaging and supporting a boat or other watercraft. Various upper bases having different respective configurations may be interchangeably engaged with the lower base, which enables the bunk assembly to be used for supporting a number of different types of boats and hull configurations.

20 Claims, 4 Drawing Sheets

WATERCRAFT SUPPORTING BUNK ASSEMBLY

RELATED APPLICATION

This application claims the benefit of U.S. Provisional Patent Application Ser. No. 62/587,619 filed Nov. 17, 2017.

FIELD OF THE INVENTION

This invention relates to a watercraft supporting bunk assembly and, more particularly, to a multiple part bunk assembly that accommodates interchangeable cushion components having a variety of respective configurations and angular orientations. The multiple part construction allows a selected cushion component to be quickly, conveniently and interchangeably attached to the bunk assembly for supporting a corresponding type of watercraft.

BACKGROUND OF THE INVENTION

Boats and other types of watercraft must be supported in a stable, safe and secure manner when such vessels are removed from the water. Typically, such support is provided by a parallel pair of elongate members commonly known as bunk beams or bunk boards (referred to hereinafter as "bunk assemblies"). Such bunk assemblies are utilized in various watercraft supporting structures such as boat lifts, boat trailers, dry dock structures and boat supporting platforms.

Each bunk assembly conventionally employs an elongate metal beam, which is secured to and extends across a respective plurality of vertical support posts. See, for example, U.S. Pat. No. 6,830,410. The beam is constructed and configured to carry an elongate cushion, which directly engages the hull of the vessel being supported. Such cushioned beams are designed to securely support the boat without scratching the hull. However, watercraft employ hulls having a wide assortment of shapes and angular configurations. These include, but are not limited to V-hull and step hull vessels, pontoon boats, flat deck vessels and multiple-hull watercraft. Each known bunk assembly is usually compatible with only a single or, at most, a limited variety of hull configurations. In order to properly support a vessel having an alternative hull configuration on a boat lift, trailer or other supportive structure, the existing bunk assemblies must first be removed and replaced with bunk assemblies having a specific angular configuration corresponding to the hull of the boat to be supported. This can be a tedious, time consuming and often expensive procedure for the boat owner, marina or boatyard personnel or boat manufacturer to perform. In order replace the bunk assemblies, the previously attached assemblies must first be disconnected and removed from the remainder of the vessel support structure. The replacement bunk assemblies must then be attached by bolts, rivets or alternative fastening means. This process also requires maintaining an inventory of often bulky and unwieldy bunk assemblies in order to accommodate a variety of boat hull configurations.

SUMMARY OF THE INVENTION

It is therefore an object of the present invention to provide an improved watercraft bunk assembly that may be quickly, conveniently and inexpensively adapted to effectively accommodate and support vessels having virtually all types of hull configurations.

It is a further object of this invention to provide a watercraft bunk assembly that is readily adaptable for use with virtually all types and shapes of boats and boat hulls including, but not limited to, V-hulls, step hulls, pontoon boats, flat deck vessels and multi-hull vessels.

It is a further object of this invention to provide a watercraft bunk assembly that does not have to be fully disengaged and removed from the rest of a boat supporting structure in order to accommodate a vessel having a different hull configuration.

It is a further object of this invention to provide a watercraft bunk assembly that is effective for use in all types of watercraft support structures including, but not limited to boat lifts, boat trailers, boat supporting platforms and dry dock structures.

It is a further object of this invention to provide a watercraft bunk assembly featuring an interchangeable, multiple part construction that reduces the need to maintain a costly and space consuming inventory of bulky, unwieldy and heavy bunk boards for engaging and supporting respective types of boats and boat hulls.

It is a further object of this invention to provide a watercraft bunk assembly that may be used conveniently and effectively by boat owners and operators, marinas, boat yards and manufactures of boats, boat lifts, trailers and other boating related products.

This invention features a watercraft bunk assembly including an elongate lower base that is attached to an underlying support structure. The base includes an elongate plate disposed on a top surface of the underlying support structure. A spaced apart pair of flanges depend from respective longitudinal sides of the plate. One or more connectors join the flanges to the underlying support structure. The base further includes a longitudinal slot formed above the plate. The slot is defined by a pair of upper extensions of the respective flanges, which extensions are attached to the plate and configured to form an opposing pair of retainer tracks along respective longitudinal edges of the plate. The slot slidably and interchangeably receives an elongate upper base. The upper base includes longitudinal top and bottom walls interconnected by a pair of longitudinal side walls. An opposing pair of longitudinal ribs extend respectively outwardly from the side walls. Each rib is slidably received by a respective track of the longitudinal slot for retaining the upper base against the lower base. The top wall of the upper base carries a longitudinal cushion component and the side walls are configured to hold the cushion component at an orientation for corresponding to and engaging the hull of the vessel to be supported. The ribs of the upper base are slid longitudinally through the tracks of the lower base to disengage and remove the upper base and attached cushion component from the lower base. An alternatively configured support base holding a cushion component at a different angular orientation may then be attached to the lower base by sliding the ribs of the alternatively configured upper base longitudinally into the respective tracks of the slot.

In a preferred embodiment the underlying support structure may include a vertical support post of a boat lift or other watercraft supporting structure. The upper longitudinal extensions may include L-shaped cross sectional shapes, which form the opposing tracks. Each flange may include a uniform thickness from an upper end to a lower end of the flange. The ribs may be formed in respective lower ends of the side walls of the upper base. The ribs may be coplanar extensions of the bottom wall of the upper base that extend outwardly of the side walls.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
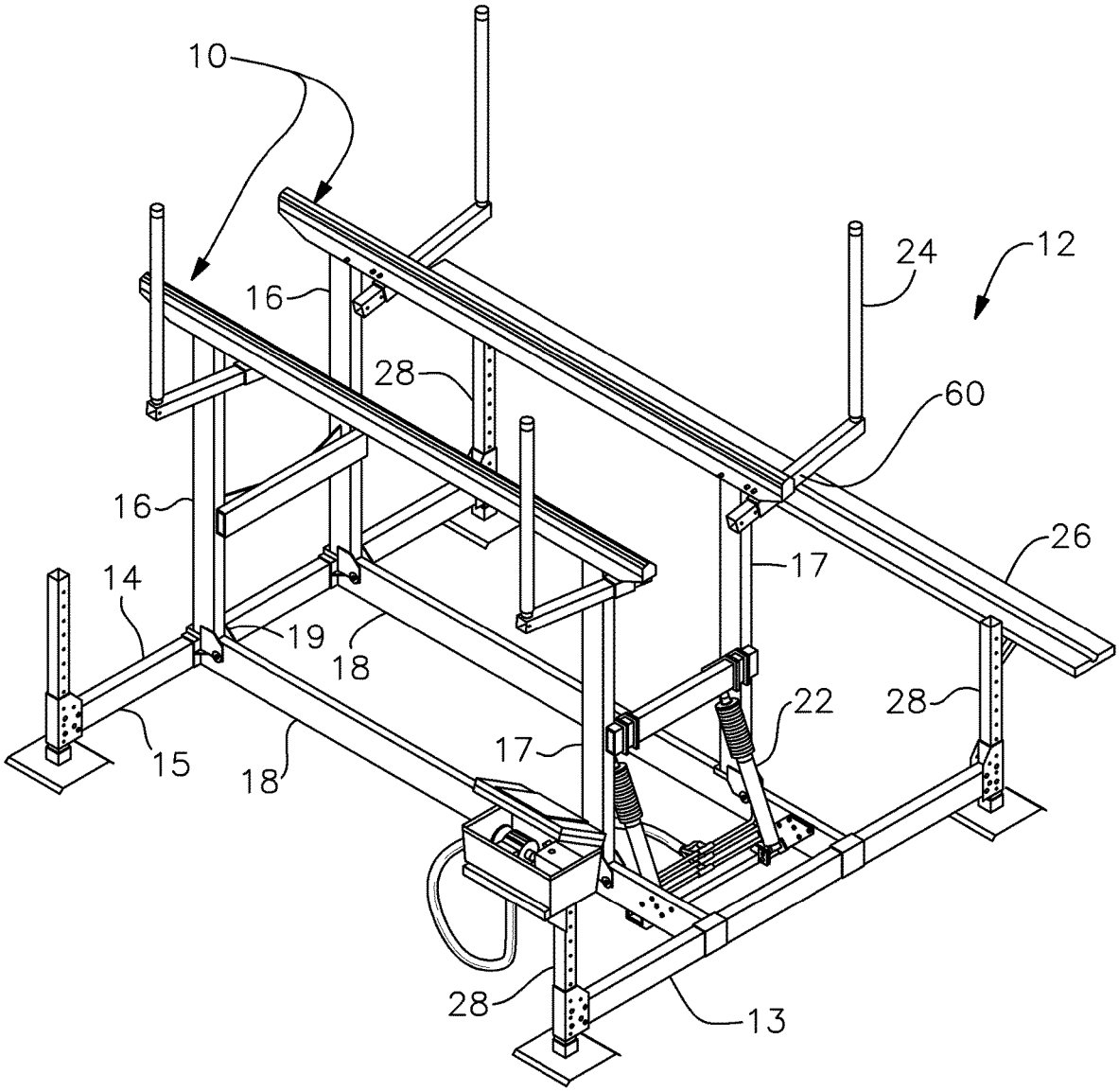
FIG. 1 is a perspective view of a boat lift that employs the watercraft bunk assembly of this invention.

There is shown in FIG. 1 a pair of multiple part bunk assemblies 10 that are incorporated in a hydraulically operated aluminum boat lift 12 in accordance with this invention. The boat lift features a supportive framework 14 that is positioned in a body of water, not shown. Framework 14 is adjustably mounted on supportive stanchions 28, which are themselves mounted on the bottom or floor of a body of water. The framework may be adjusted vertically along stanchions 28 so that the height of boat lift 12 within the body of water may be set as required for a particular vessel.

Framework 14 includes a pair of generally parallel longitudinal beams 18. These beams extend between forward and rearward transverse beams 13 and 15, which are themselves mounted to and height adjustable along stanchions 28. A first pair of posts 16 are pivotally mounted at their lower ends to respective longitudinal beams 18 proximate one end of framework 14. An opposite second pair of posts 17 are likewise pivotally connected at their lower ends to respective longitudinal beams 18 proximate the opposite end of framework 14. A pair of generally parallel cradle beam assemblies 10 are pivotally connected to the upper ends of the support posts such that each cradle beam assembly 10 extends between a respective pair of posts 16 and 17. The lower end of each post 16, 17 is pivotally secured to a respective lower longitudinal beam assembly 18 by a respective pivot bracket 19.

The pivoting support posts and cradle beam assemblies 10 supported by the support posts 16, 17 are selectively raised and lowered by a pair of hydraulic cylindrical actuators 22. The construction and operation of these actuators is described in my provisional Patent Application No. 62/530,470, filed Jul. 10, 2017.

A pair of cradle beam assemblies 10 are utilized to support a boat or other watercraft vessel on boat lift 12. It should be understood that boat lift 12 may also include a number of other conventional boat lift components. For example, as further shown in FIG. 2, vertical guides 24 may be mounted to and extend upwardly from cradle beam assemblies 10. Guides 24 help to properly position the boat B onto boat lift 12. An optional walkway 26 may likewise be mounted upon framework 14 to facilitate boarding and departure onto and from the vessel respectively. It should be understood that the above-described boat lift construction is largely conventional.

Cradle beam assemblies 10 are disclosed herein as components of hydraulically operated boat lift 12. However, it should be understood that cradle assembly 10 of the present invention may likewise be incorporated into various other structures for supporting all sorts of boats and other types of watercraft. This may include, but is not limited to, storage facilities, dry docks, trailers, etc. The particular environment or application in which the bunk assembly is employed is not a limitation of this invention, although it has been determined that the use of the beam assembly described herein is particularly effective for use in boat lift applications such as those disclosed herein.

Figure 2:
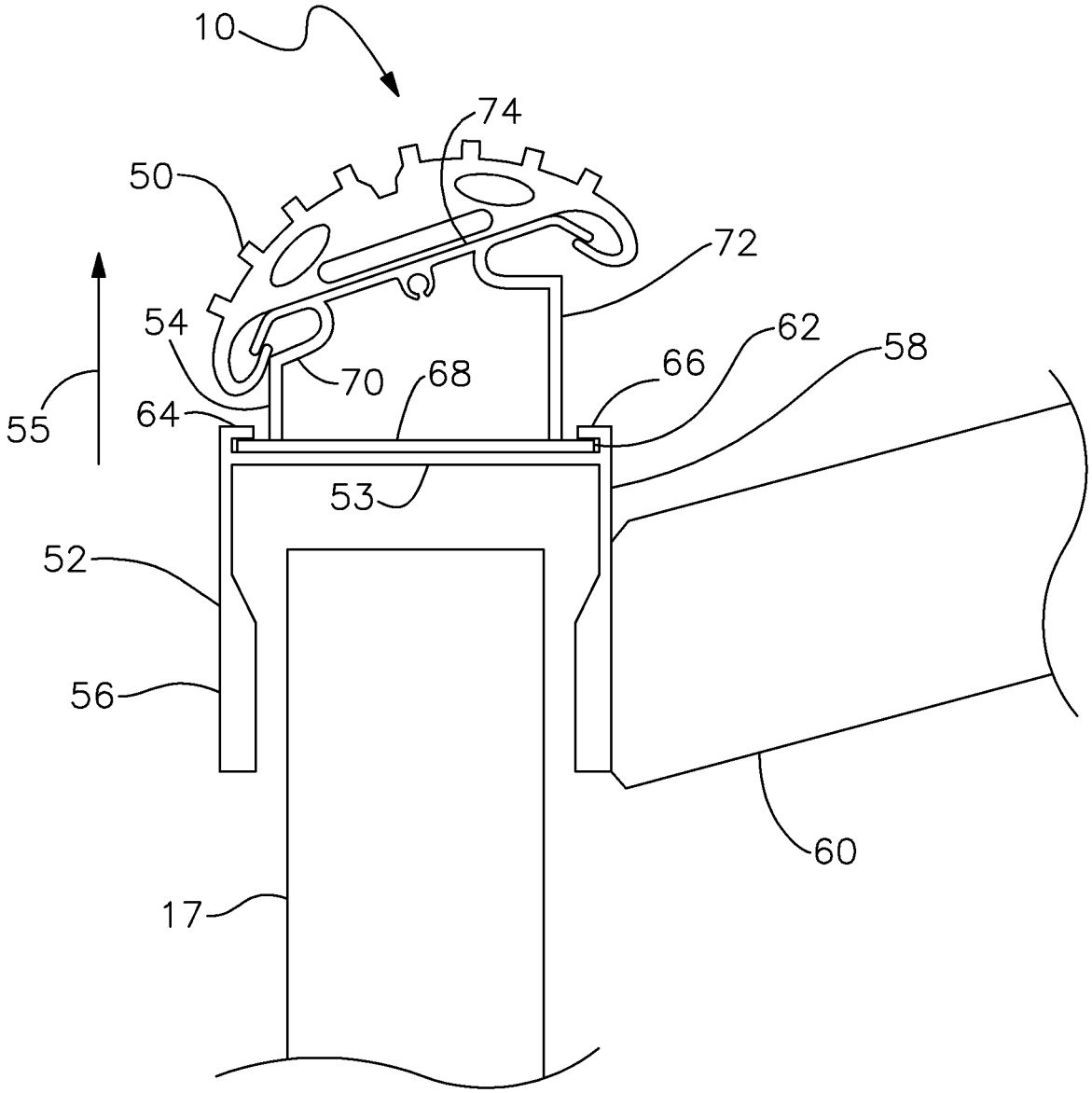
FIG. 2 is an elevated end view of a representative bunk assembly in accordance with this invention; for clarity, the assembly is shown spaced slightly above and not connected to an underlying support post.

FIG. 2 depicts a representative bunk assembly 10. This particularly includes the right hand bunk assembly as depicted in FIG. 1 wherein a cushioned component 50 is oriented inwardly at an angle such that it securely engages and cushions a corresponding and similarly angled side of a boat hull supported by the lift. The other bunk assembly, which is not specifically depicted, has a corresponding, mirror image shape and angular orientation wherein the associated cushion component faces inwardly in an opposite direction for similarly engaging the other side (port or starboard) of the boat hull. The configuration depicted in FIGS. 2-4 extends for the entire length of each bunk assembly depicted in FIG. 1.

Figure 3:
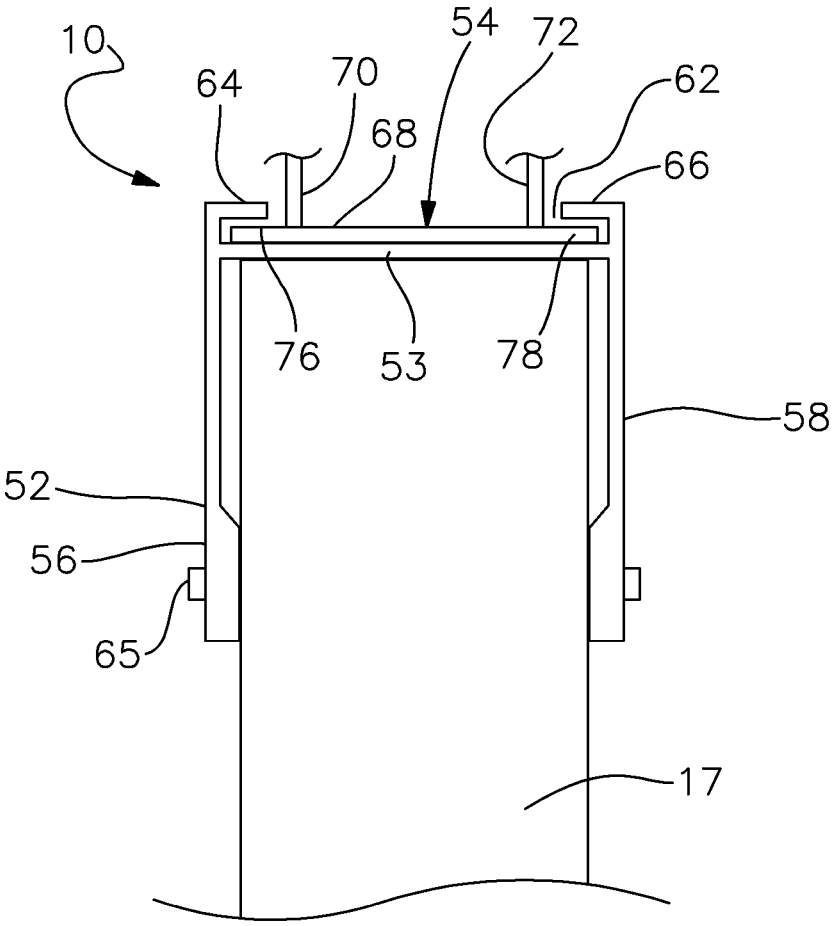
FIG. 3 is a fragmentary elevational end view of the lower base of the bunk assembly secured to the support post of the boat lift and with the upper base of the bunk assembly slidably interengaged with the longitudinal slot formed in the lower base.

As further shown in FIGS. 2 and 3, bunk assembly 10 features a multiple part construction in accordance with this invention. Specifically, each bunk assembly includes an elongate lower base 52 and an entirely separate elongate upper base 54 that is longitudinally slidably interengaged with lower base 52 by means of complementary first and second sliding connectors as described below. Each of the upper and lower bases is composed of a strong and durable material such as aluminum, steel or other metal alloys.

Lower base 52 includes a first connector including a generally flat longitudinal plate 53. Longitudinal flanges 56 and 58 are connected to respective longitudinal edges of upper plate 53 and depend therefrom on respective sides of post 17. It should be understood that in FIG. 2 the flanges are not yet secured to post 17. FIG. 2 also depicts a bracket 60 for carrying one of the vertical guides 24 shown in FIG. 1. Bracket 60 is attached to flange 58 of lower base 52 by a bolt, rivet or other appropriate fastening means proximate one end of bunk assembly 10, see FIG. 1. Two such brackets and attached guides are similarly connected to each of the bunk assemblies as depicted in FIG. 1.

Lower base 52 further includes a first connector having a longitudinal slot 62, FIGS. 2 and 3, for slidably and interchangeably receiving upper base 54. In particular, slot 62 is defined by a pair of longitudinal flange extensions 64 and 66 extending upwardly from plate 53 of lower base 52. Each of the flange extensions 64 and 66 has a generally L-shaped cross sectional configuration. As a result, a retainer track is formed along each longitudinal edge of lower base 52. These tracks define a slot for slidably receiving upper base 54 in a manner described more fully below.

Figure 4:
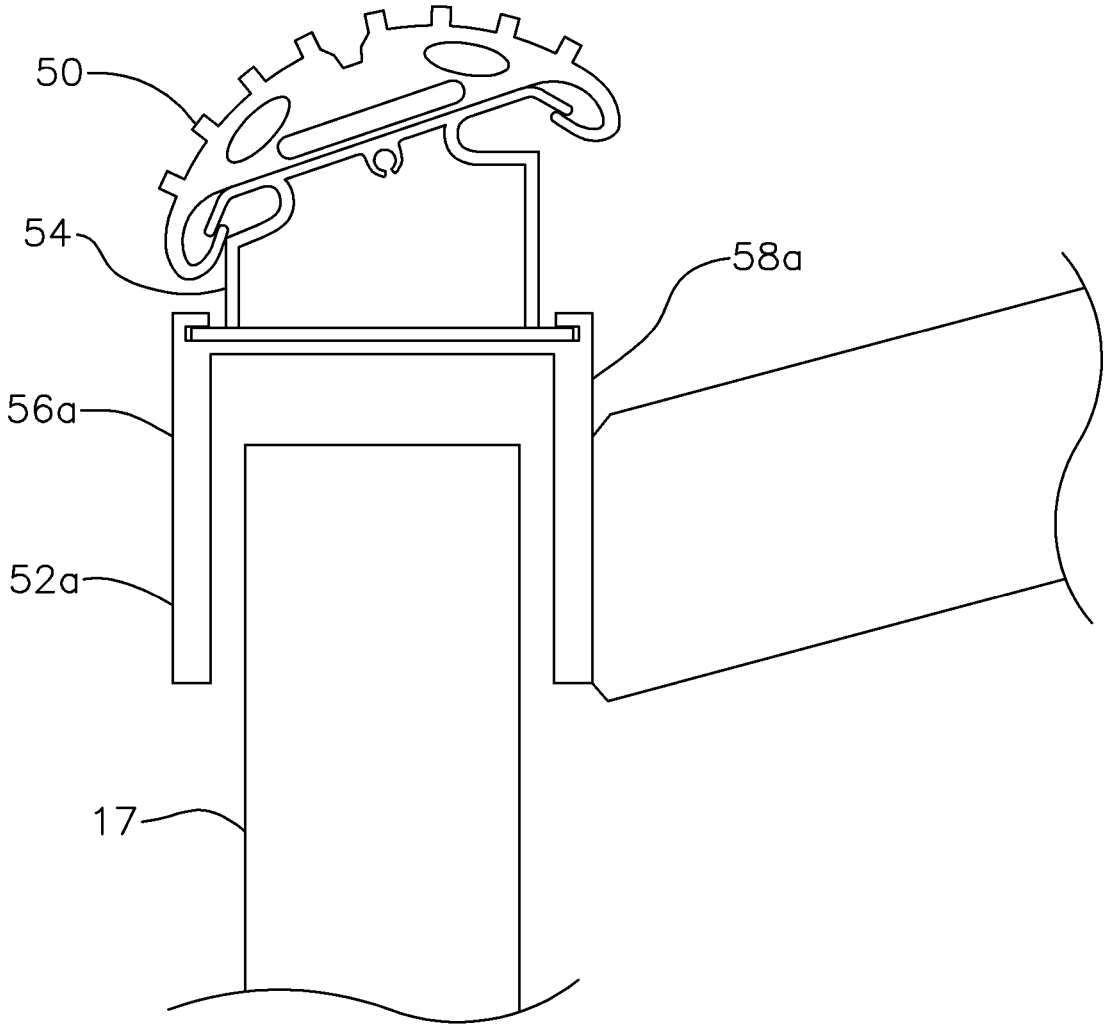
FIG. 4 is an elevational end view of an alternative bunk assembly in accordance with this invention wherein the spaced apart flanges of the lower base include uniform thicknesses extending from the upper end to the lower end of each flange.

Upper base 54 includes a flat longitudinal bottom wall 68 that is joined to an opposing pair of longitudinal side walls 70 and 72. The side walls support a longitudinal top wall 74 and are configured, as best shown in FIGS. 2 and 4, to provide the bunk assembly with the angular orientation required for properly supporting a vessel thereon. More particularly, walls 70 and 72 are shaped to provide attached top wall 74 with the angular inclination depicted therein.

The side walls may employ various alternative shapes to provide different respective angular orientations. Top and bottom walls 74, 68 are secured unitarily to the side walls 70 and 72. Top wall 74 has downwardly curved longitudinal edges. Cushion component 50 is wrapped about these curved longitudinal edges and secured to the underside of top wall 74 such that the cushion component is held securely in place at the angle or inclination dictated by upper wall 74.

Bottom wall 68 of upper base 54 extends laterally outwardly beyond side walls 70 and 72. The opposing longitudinal edges of plate 53 thereby define a second connector comprising respective retainer ribs or shoulders 76, 78 (FIG. 3) that are slidably received in the tracks formed by inwardly turned flange extensions 64 and 66. As a result, bottom wall 68 of upper base 54 is retained by or captured within slot 62 of lower base 52. Upper base 54 is restricted from being separated from lower base 52 in the direction of arrow 55. Flat bottom wall 68 of upper base 54 flushly and slidably interengages plate 53 of lower base 52. The upper base 54 is thereby allowed to slide longitudinally through the slot 62 of lower base 52.

Bunk assembly 10 is attached to the upper end of each supporting post 17 by simply overlapping flanges 56 and 58 of lower base 52 over corresponding sides of post 17. See FIG. 3. A rivet 65 or other appropriate form of connector is then interengaged with flanges 56 and 58 and intermediate post 17 through aligned holes formed in these components in a standard manner.

As previously described, upper base 54 may be configured to hold cushion component 50 at various angular inclinations. A user (who may comprise a boat owner or operator, a marina or boatyard operator, or a supplier/manufacturer of boats, lifts, trailers or boat supporting accessories) will typically maintain a supply of the upper bases 54 and attached cushion components 50 having various selected configurations. This allows the user to conveniently select and interchange the shape and corresponding angular inclination of the upper base as required for supporting particular boat hull configurations. Changing the upper base and attached cushion component is performed quickly and conveniently without having to remove the entire bunk assembly. To do this, the upper base 54 and attached cushion component 50 are simply slid longitudinally through the longitudinal slot 62 in lower base 52 until the upper base is disengaged from the lower base. The ribs 76 and 78 of upper base 54 slide longitudinally through and out of the opposing tracks of the lower base. Wall 68 of upper base 54 slides easily across plate 53 of lower base 52.

The upper base 54 and attached cushion component 50 are slid longitudinally relative to lower base 52 and are removed through an open end of the slot at one or both of the ends of the longitudinal bunk assembly. The removed components may then be replaced by an alternatively configured upper base and attached cushion component. This is accomplished by simply slidably inserting the replacement upper base into the slot of the lower base. In particular, ribs 76 and 78 of upper base 54 are slid through the respective tracks formed by flange extensions 64 and 66 until the plate 68 of upper base 54 is fully received in slot 62 of lower base 52. Both of the parallel bunk assemblies 10 are reinstalled in an analogous manner to provide the bunk assemblies with the new angular inclinations required to support a corresponding vessel.

FIG. 4 shows a slightly alternative embodiment wherein lower base 52*a* has a different configuration. In particular, each of flanges 52*a* and 58*a* has a vertical uniform thickness from top to bottom. This thickness should be sufficient at a lower end of each flange to provide for secure attachment of the lower base to the support post 17. At the same time, the uniform thickness proximate the top of the flange achieves improved structural integrity and greater bunk assembly strength. Improved watercraft support is thereby provided.

In alternative embodiments, the upper and lower bases may be reconfigured such that a longitudinal slot is formed in the base and shoulders, ribs or other forms of slide elements are carried by the lower base. Moreover, although the upper and lower bases are preferably interengaged such that the upper base is longitudinally slidable relative to the lower base, in certain versions of the invention, the upper base may be interchangeably mounted on the lower base and captured or otherwise held in place by means other than complementary slidably interengaged components. For example, one of the upper and lower bases may include pins, clips or other types of connectors that are received by slots or other variety of complementary connectors formed in the other base. The upper and lower bases may also include corresponding fastening holes that are aligned and interconnected by bolts, or other forms of releasable interconnection. The slidable form of interconnection disclosed herein is particularly preferred as it permits the selected upper base and properly angled cushion or other hull-engaging component to be quickly and conveniently installed, removed and interchanged as required. The slidable connection also enables the upper base to be securely, but releasably retained and captured by the lower base so that a supported marine vessel is held securely in place on the supporting structure.

The multiple part bunk assembly of the present invention is quickly and conveniently interchangeable. Quite significantly, when the bunk angle must be adjusted, the entire bunk assembly does not have to be detached from the boat lift or other supportive structure as is required in the prior art. In particular, rivets, bolt or other fastening means do not have to be tediously removed. This saves both time and expense. A more convenient and versatile bunk assembly is thereby available which can be used beneficially by boat owners and operators, marinas and docking facilities and suppliers and manufactures of boats, boat lifts, boat supporting structures and boating accessories.

It should be understood that the shape and resulting angular inclination featured by the upper base may be varied within the scope of this invention to operate effectively in various environments and boat supporting applications and to achieve stable and safe support for such applications. The assembly of this invention can fit and be used effectively with many types of vessels and varieties of boat hulls, including but not limited to V-hulls, step hulls, pontoon boats, flat deck vessels, multi-hull watercraft and otherwise.

From the foregoing, it maybe seen that this invention provides for an interchangeable multiple-piece bunk assembly for safely and securely supporting boats and many other types of watercraft. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. An interchangeable watercraft bunk assembly for use in a boat supporting structure, said assembly comprising:

a lower base for attaching to the boat supporting structure, said lower base including a slot defined by a pair of spaced apart retainer tracks formed along said lower base; and a plurality of upper bases that are selectively and interchangeably interengageable with said lower base, each upper base carrying a spaced apart pair of retainer ribs, each said retainer rib being slidably receivable by a respective one of said retainer tracks to interconnect a selected said upper base with said lower base, each said upper base supporting a respective boat hull engagement cushion component that is separate and distinct from and not unitarily connected to said upper base, each said upper base being oriented at an angular inclination different from that of each other said upper base for corresponding to the hull of a boat to be supported on the boat supporting structure, whereby a selected one of said upper bases is selectively and interchangeably interengaged with said lower base by slidably inserting said retainer ribs of said selected upper base into said retainer tracks of said lower base and disengaged from said lower base by slidably removing of said retainer ribs of said selected upper base from said retainer tracks of said lower base.

2. The assembly of claim 1 in which said lower base and each said upper base is composed of metal.

3. The assembly of claim 1 in which each said upper base consists of a metal composition and said cushion component consists of a relatively flexible cushioning composition.

4. A watercraft bunk assembly for use in a boat supporting structure, said assembly comprising:

a lower base for attaching to the boat supporting structure; and an upper base that is releasably attached to said lower base, said upper base for supporting a separate and distinct boat hull engagement cushion component, which is not unitarily connected to said upper base, at a selected angular inclination corresponding to the hull of a boat to be supported on the boat supporting structure;

one of said upper and lower bases including a first connector and the other of said upper base and said lower base including a complementary second connector, which first and second connectors are releasably interconnected for supporting said boat hull engagement cushion component at said selected angular inclination on the boat supporting structure, whereby said cushion component engages and cushions the hull of a boat supported on the boat supporting structure.

5. The assembly of claim 4 in which said lower base includes a plate for directly engaging and extending substantially horizontally and without inclination across a top surface of the boat supporting structure.

6. The assembly of claim 5 in which said lower base includes a spaced apart pair of flanges depending from opposing longitudinal edges of said plate.

7. The assembly of claim 6, in which said retainer tracks are defined by respective upward extensions of said flanges formed respectively along said opposing sides of said plate.

8. The assembly of claim 7 in which each said flange extension includes an L-shaped cross sectional configuration to define a respective said retainer track.

9. The assembly of claim 6 in which each said flange includes a uniform thickness from an upper end to a lower end of said flange.

10. The assembly of claim 4, in which first connector includes a slot defined by a pair of retainer tracks formed on e of said upper base and said lower base and said second connector includes a pair of retainer ribs formed in the other of said upper base and said lower base, each said rib being slidably received by a respective one of said retainer tracks to interconnect said upper and lower bases.

11. The assembly of claim 10 in which said upper base includes top and bottom walls interconnected by a pair of side walls.

12. The assembly of claim 11 in which said boat hull engagement cushion component interengages and is attached to said top wall of said base.

13. The assembly of claim 11 in which retainer tracks are formed in said lower base and said retainer ribs are respectively defined by opposing coplanar extensions of said bottom wall that extend respectively beyond said side walls of said upper base each said retainer rib being slidably received in a respective said retainer track.

14. The assembly of claim 11 in which said side walls of said upper base are configured to hold said hull engagement component at said selected angular inclination.

15. The assembly of claim 4 in which said first connector includes a longitudinal slot configured to capture said second connector therein and permit said second connector to slide longitudinally through said slot, said slot having an open end to permit said second connector to be selectively introduced into and removed from said longitudinal slot.

16. The assembly of claim 4 in which said upper base is composed of metal.

17. A watercraft bunk assembly for use in a boat supporting structure, said assembly comprising:

an elongate lower base for attaching to the boat supporting structure;

an elongate upper base that is releasably attached and slidably interengaged with said lower base;

said lower base including a longitudinal plate and a pair of spaced part longitudinal flanges depending from said plate, said upper base including a longitudinal lower wall slidably interengaging said plate of said lower base, said upper base further including a spaced apart pair of longitudinal side walls joined to and extending upwardly from said bottom wall and a top wall supported by said side walls, said wide walls of said upper base being configured to support said top wall at a selected angular inclination corresponding to the hull of a boat to be supported on the boat supporting structure; and an elongate boat hull engaging cushion component, which is separate and distinct from and not unitarily joined to said upper base, said cushion component being attached to and supported by said top wall of said upper base such that said cushion component is directed by said top wall at the selected angular inclination for engaging and cushioning the hull of a boat supported on the boat supporting structure.

18. The assembly of claim 17 in which each of said upper and lower bases includes a metallic composition.

19. The assembly of claim 17 in which said cushion component includes a bottom cushion wall for flushly engaging and connecting to said top wall of said upper base.

20. The assembly of claim 17 in which said flanges depend generally perpendicularly from said plate of said lower base, said flanges being fastened to the boat supporting structure such that said plate engages and extends substantially horizontally and without inclination across the boat supporting structure.

* * * * *